US009408779B2

(12) United States Patent
Stewart

(10) Patent No.: US 9,408,779 B2
(45) Date of Patent: Aug. 9, 2016

(54) BOTTLE AND CUP HOLDER

(71) Applicant: Glenn Stewart, Cleveland Heights, OH (US)

(72) Inventor: Glenn Stewart, Cleveland Heights, OH (US)

( * ) Notice: Subject to any disclaimer, the term of this patent is extended or adjusted under 35 U.S.C. 154(b) by 487 days.

(21) Appl. No.: 13/893,480

(22) Filed: May 14, 2013

(65) Prior Publication Data

US 2013/0299443 A1 Nov. 14, 2013

Related U.S. Application Data

(60) Provisional application No. 61/646,442, filed on May 14, 2012.

(51) Int. Cl.
*A61J 9/06* (2006.01)

(52) U.S. Cl.
CPC .. *A61J 9/06* (2013.01); *A61J 9/0607* (2015.05)

(58) Field of Classification Search
CPC .... B65D 1/323; B65D 47/242; B65D 47/265; B65D 51/1616; B65D 81/18; B65D 81/3846; B65D 81/3874; B65D 81/3883; B65D 81/3886; B65D 2205/00; A47G 19/12; A47G 19/127; A47G 19/2266; A47G 19/2272; A47G 19/2288; A47G 21/18; A47G 2400/027; F25D 3/08; F25D 7/00; F25D 31/007; F25D 31/008; F25D 2303/081–2303/082; F25D 2303/0822; F25D 2303/08221; F25D 2303/0831–2303/0832; F25D 2303/0841–2303/0843; F25D 2303/0845; F25D 2303/085; F25D 2331/81; F25D 2331/803–2331/806; F25D 2331/808–2331/809; F25D 2400/26; A47J 36/2444; A47J 41/00; A47J 41/0044; A47J 41/0083; A47J 41/0094

USPC ..... 215/11.6, 12.1, 13.1; 220/737–740; 446/73–76, 304, 305, 595–597; 473/595–597; D7/514, 515, 606, 623, D7/624.3, 625

See application file for complete search history.

(56) References Cited

U.S. PATENT DOCUMENTS

| | | | | | |
|---|---|---|---|---|---|
| 1,383,838 | A | * | 7/1921 | Mrazek | 222/78 |
| 2,994,448 | A | * | 8/1961 | Sepe et al. | 215/395 |
| 3,090,478 | A | * | 5/1963 | Stanley | B65B 43/54 141/177 |
| 3,120,319 | A | * | 2/1964 | Buddrus | 215/12.2 |
| D201,336 | S | * | 6/1965 | Nelson | D24/198 |
| 3,341,045 | A | * | 9/1967 | Sandler | 215/12.2 |
| 3,356,243 | A | * | 12/1967 | Piker | 215/13.1 |
| D212,818 | S | * | 11/1968 | Flaherty | D7/511 |
| 3,463,140 | A | * | 8/1969 | Rollor, Jr. | 126/246 |
| D228,328 | S | * | 9/1973 | Schley | D7/507 |
| 3,998,072 | A | * | 12/1976 | Shaw | 62/457.4 |
| D242,971 | S | * | 1/1977 | Schlichter | D7/515 |
| D249,438 | S | * | 9/1978 | Meier et al. | D7/511 |
| 4,163,374 | A | * | 8/1979 | Moore et al. | 62/457.4 |
| 4,164,284 | A | * | 8/1979 | Witt et al. | 206/217 |
| 4,183,226 | A | * | 1/1980 | Moore | 62/457.4 |

(Continued)

*Primary Examiner* — J. Gregory Pickett
*Assistant Examiner* — Brijesh V. Patel
(74) *Attorney, Agent, or Firm* — Calfee, Halter & Griswold LLP

(57) ABSTRACT

A bottle and cup holder for retaining a bottle or cup, having a skin cover forming an outermost layer of the holder; a foam insert within the skin cover having a central cavity and an opening. The central cavity has a first section, a second section, and a shoulder. The second section is between the first section and the opening. The shoulder is between the first section and the second section. The second section has a larger diameter than the first section. The bottle and cup holder also has a shoulder bushing within the opening and extending into the central cavity to receive the bottle or cup.

14 Claims, 8 Drawing Sheets

(56) References Cited

U.S. PATENT DOCUMENTS 4,281,520 A * 8/1981 Norwood ..... 62/372
4,293,015 A * 10/1981 McGough ..... 220/739
4,299,100 A * 11/1981 Crisman et al. ..... 62/457.4
4,372,453 A * 2/1983 Branscum ..... 215/12.2
4,383,422 A * 5/1983 Gordon et al. ..... 62/457.4
4,549,410 A * 10/1985 Russell ..... 62/457.8
D288,362 S * 2/1987 Simmons ..... D24/198
4,681,239 A * 7/1987 Manns et al. ..... 220/592.16
D292,463 S * 10/1987 Petrasek ..... D7/515
4,708,254 A * 11/1987 Byrns ..... 215/13.1
4,721,216 A * 1/1988 Kinder ..... A47G 23/0216 215/393
4,736,948 A * 4/1988 Thomas ..... 473/613
4,793,149 A * 12/1988 Riche ..... 62/293
4,798,063 A * 1/1989 Rimmer ..... 62/457.4
4,815,999 A * 3/1989 Ayon et al. ..... 446/73
4,882,914 A * 11/1989 Haines-Keeley et al. .... 62/457.4
4,932,225 A * 6/1990 Bighouse ..... 62/457.4
D311,581 S * 10/1990 Mosley ..... D24/197
5,022,549 A * 6/1991 Beaver ..... B60N 3/102 220/484
D319,008 S * 8/1991 Leon ..... D9/668
5,067,922 A * 11/1991 McMahon ..... 446/71
D323,602 S * 2/1992 Katz ..... D7/316
5,243,835 A * 9/1993 Padamsee ..... 62/457.2
5,271,244 A * 12/1993 Staggs ..... 62/457.3
D351,656 S * 10/1994 Collins ..... D24/198
D351,971 S * 11/1994 Cappola ..... D7/625
D352,211 S * 11/1994 Rucks ..... D7/625
5,361,604 A * 11/1994 Pier et al. ..... 62/457.4
D354,642 S * 1/1995 Stoddard et al. ..... D6/450
5,397,261 A * 3/1995 Malewicki et al. ..... 446/71
D359,655 S * 6/1995 Hurst et al. ..... D7/515
5,450,979 A * 9/1995 Servick et al. ..... 220/739
5,467,891 A * 11/1995 Perry ..... 220/739
5,503,296 A * 4/1996 DiBaggio ..... 220/708
D371,934 S * 7/1996 Cwirko ..... D7/515
5,653,124 A * 8/1997 Weber ..... 62/457.4
5,662,241 A * 9/1997 Sorensen ..... 220/630
D391,155 S * 2/1998 Edson et al. ..... D9/668
D392,844 S * 3/1998 Todorya ..... D7/606
D409,904 S * 5/1999 Clements et al. ..... D9/668
D411,442 S * 6/1999 Edson et al. ..... D9/668
6,045,469 A * 4/2000 Gleason et al. ..... 473/613
D424,375 S * 5/2000 D'Arrigo ..... D7/510
D424,876 S * 5/2000 McPartland ..... D7/510
D425,757 S * 5/2000 Printz et al. ..... D7/510
6,094,935 A * 8/2000 Stein ..... 62/457.3
D477,132 S * 7/2003 Bond et al. ..... D3/202
6,588,621 B2 * 7/2003 Shimazaki ..... 220/592.17
D478,480 S * 8/2003 Leon ..... D7/624.1
6,626,326 B2 * 9/2003 Murakami ..... B65D 81/3881 220/23.87
D511,212 S * 11/2005 Whalen ..... D24/197
D518,596 S * 4/2006 Angeletta ..... D28/7
D541,111 S * 4/2007 Morgan et al. ..... D7/625
D562,073 S * 2/2008 Yeh ..... D7/515
D565,288 S * 4/2008 Hickman ..... D3/201
D571,670 S * 6/2008 Lepoitevin ..... D9/668
D574,664 S * 8/2008 Thompson ..... D7/515
D575,079 S * 8/2008 Hirsh ..... D6/434
D580,775 S * 11/2008 Harris ..... D9/668
D587,968 S * 3/2009 Campbell ..... D7/510
D589,765 S * 4/2009 Zuloff ..... D7/515
D599,625 S * 9/2009 Lessells ..... D7/625
D608,590 S * 1/2010 Geter et al. ..... D7/515
D609,111 S * 2/2010 Bentley et al. ..... D9/668
D614,504 S * 4/2010 Coat ..... D9/668
D619,856 S * 7/2010 Carter ..... D7/625
D621,657 S * 8/2010 Quinn ..... D7/507
7,784,759 B2 * 8/2010 Farrell ..... 248/315
D623,905 S * 9/2010 Paslawski ..... D7/625
D624,368 S * 9/2010 Paslawski ..... D7/625
D633,342 S * 3/2011 Paslawski ..... D7/625
7,954,634 B2 * 6/2011 Blakeman ..... 206/233
D666,919 S * 9/2012 Gelin ..... D9/668
D673,428 S * 1/2013 Lessells ..... D7/625
8,403,778 B2 * 3/2013 Wallach et al. ..... 473/613
D686,884 S * 7/2013 Carter ..... D7/625
8,534,345 B1 * 9/2013 French et al. ..... 165/10
8,544,678 B1 * 10/2013 Hughes ..... B65D 81/3879 220/737
2002/0113072 A1 * 8/2002 Lane ..... B65D 81/3879 220/739
2003/0029876 A1 * 2/2003 Giraud ..... A47G 19/2288 220/592.17
2005/0087538 A1 * 4/2005 Wolfe ..... A47J 41/0044 220/592.16
2006/0156756 A1 * 7/2006 Becke ..... 62/457.3
2009/0057325 A1 * 3/2009 Tullio et al. ..... 220/739
2010/0314401 A1 * 12/2010 Chucales et al. ..... 220/739
2011/0009218 A1 * 1/2011 Wallach et al. ..... 473/594
2011/0079526 A1 * 4/2011 Blakeman ..... 206/457
2011/0271708 A1 * 11/2011 Baker ..... A47G 23/0208 62/457.5
2012/0193366 A1 * 8/2012 Miller ..... F25D 3/08 220/592.17
2013/0087524 A1 * 4/2013 Nuckles ..... 215/395

* cited by examiner

BOTTLE AND CUP HOLDER

CROSS-REFERENCE TO RELATED APPLICATIONS

This application claims the benefit of U.S. Provisional Patent Application No. 61/646,442 filed on May 14, 2012, which is incorporated herein by reference.

TECHNICAL FIELD OF THE INVENTION

The present invention relates generally to a sports ball bottle holder for retaining a bottle. More specifically, the present invention relates to a sports ball bottle holder including a skin cover, a foam insert having a central cavity therein, and a pouch lining within the central cavity.

BACKGROUND OF THE INVENTION

Although many healthcare professionals believe that breastfeeding is preferable to bottle-feeding, breastfeeding may not be possible or preferable for all mothers. For these mothers, the alternative requires bottle-feeding their baby stored breast milk or formula. A baby bottle is a bottle with a nipple to drink directly from. It is typically used by infants and young children when a mother does not breastfeed, or if someone cannot (as conveniently) drink from a cup, for feeding oneself or being fed. A baby bottle includes a vessel commonly made of polycarbonate, a teat commonly made of liquid silicone rubber or natural rubber, and a coupling which couples the vessel to the teat in a leak-proof manner. When a child reaches the age when he can grasp an object, he is encouraged to hold his own bottle when he is feeding in a high chair, stroller or car seat.

In today's culture, society has an enormous interest in ball-related sports. In pursuit of these ball sports, it is a common intention to introduce the next generation into the familial culture of the particular chosen ball sport. The novelty of affection for sports will enhance relationships between family members as they follow the development of the infant into his own particular sports interests. The sibling and family rivalry of favoring a particular ball sport may also result in the newborn having multiple selections of sports bottle ball from which to become exposed, which will further enhance the kindred experience.

SUMMARY OF THE INVENTION

According to an embodiment of the present invention, there is disclosed a sports ball bottle holder for retaining a bottle. The sports ball bottle holder includes a skin cover forming the outermost layer of the bottle holder. A foam insert having a central cavity therein and opening at one end to receive the bottle is disposed within the skin cover. A shoulder bushing is disposed within the opening and extends into the central cavity to receive the bottle.

According to another embodiment of the present invention, there is disclosed a sports ball bottle holder for retaining a bottle. The sports ball bottle holder includes a skin cover forming the outermost layer of the bottle holder. A foam insert having a central cavity therein and opening at one end to receive the bottle is disposed within the skin cover. A pouch lining is disposed within the central cavity for receiving the bottle. A shoulder bushing is disposed within the opening and extends into the central cavity to receive the bottle.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
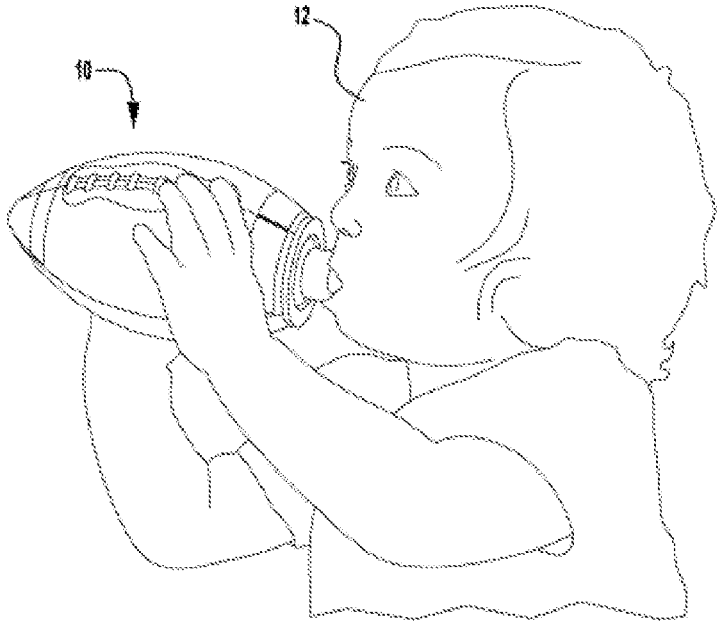
FIG. 1 is a front, three-dimensional view of a sports ball bottle holder being held by a toddler, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

FIG. 1 illustrates a front three-dimensional view of the sports ball bottle holder (hereafter "bottle holder") 10 being held by a toddler 12. The bottle holder 10 is a sports ball shaped bottle holder adapted for retaining bottles including but not limited to baby bottles and toddlers cups, with the authentic feel of a ball, such as for example, a football, basketball, baseball, or soccer ball. The principal object of the bottle holder 10 is to provide children, including babies and toddlers, with an advanced development in hand strength, grip, and familiarity with various sports balls. The bottle holder 10 has been designed to progress the development of the child's hands, sports comprehension, and awareness while bottle feeding or drinking from a toddler cup. The bottle holder 10 accomplishes these objects by providing a bottle holder in shape and overall appearance of a sports ball. Moreover, the bottle holder 10 is scaled to fit standard sizes of baby bottles and to be comfortably gripped by the toddler 12.

Figure 2:
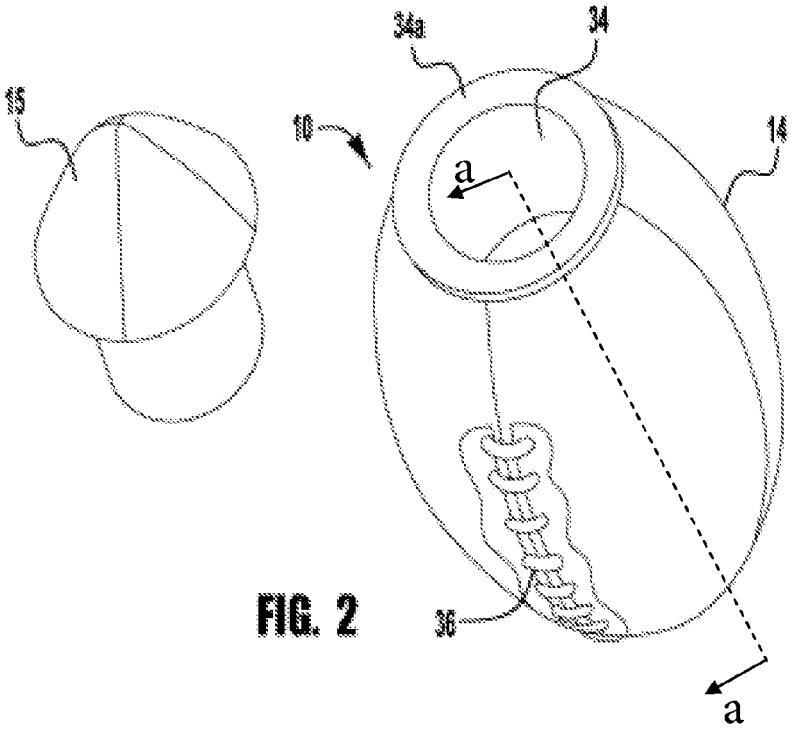
FIG. 2 is a front, three-dimensional view of a sports ball bottle holder, in accordance with the present invention.
Figure 3:
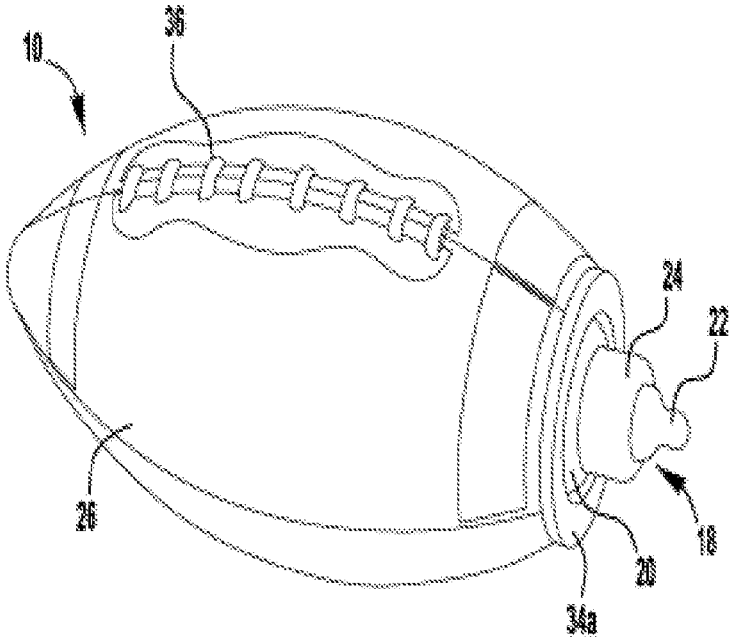
FIG. 3 is a front, three-dimensional view of a sports ball bottle holder complete with the bottle, in accordance with the present invention.
Figure 5:
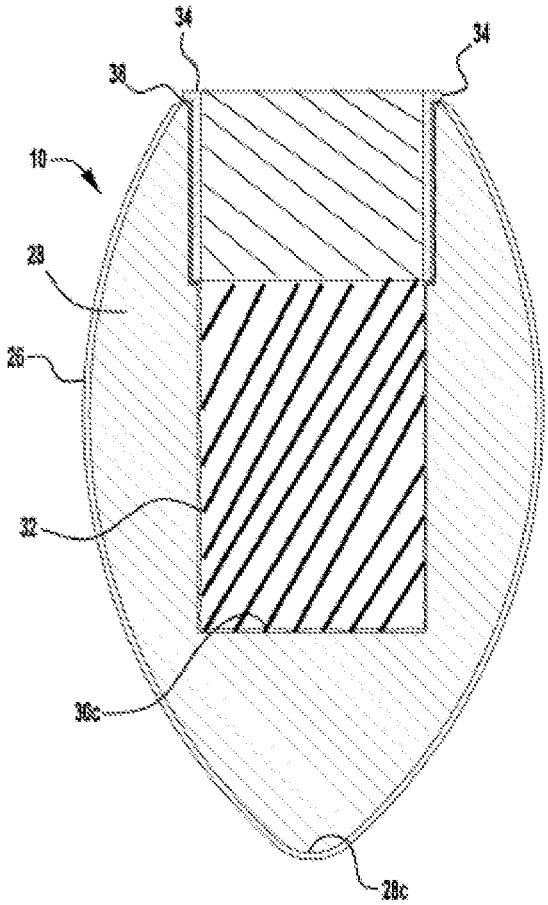
FIG. 5 is a cross-sectional view of a sports ball bottle holder, in accordance with the present invention.

FIG. 2 and FIG. 3 illustrate a front three-dimensional view of the bottle holder 10. The bottle holder 10 may have the appearance of any desired sports ball. A football shaped embodiment 14 has been illustrated in FIG. 2, but any desired sports ball, such as a soccer ball, baseball, softball, cricket ball, golf ball, tennis ball, volleyball, or basketball shaped embodiment 16, as illustrated in FIG. 5 may be utilized. The shape of the bottle holder 10 is not necessary spherical, as with most sports balls, but the shape can be ellipsoidal like that of a football shaped embodiment 14. Furthermore, the bottle holder 10 is in a scaled size appropriate to be manufactured, constructed, or otherwise built so as to receive a range of standard baby bottle 18 sizes. For example, the football shaped embodiment may have a length between about four inches and twelve inches.

The scale of each bottle holder 10 may be increased or decreased in size to accommodate a plurality of popular baby bottle 18 sizes, such as five-ounce or nine-ounce bottles, both of which are two primary standard baby bottle sizes available. The diameter of the bottle older is such that a toddler can comfortably hold the bottle holder, as seen in FIG. 1. Further, bottle holder 10 can accommodate toddler cups (not shown). For example, a golf ball shaped bottle holder 10 would be increased from its normal size to a scale suitable for one of the baby bottle sizes mentioned previously. Similarly, a basketball shaped embodiment 16 is reduced from its normal size to a scale fitting one of the baby bottle sizes mentioned previously. A baby bottle includes a vessel 20 commonly made of polycarbonate, a teat 22 commonly made of liquid silicone rubber or natural rubber, and a coupling 24 which couples the vessel to the teat in a leak-proof manner. It is within the terms of the embodiment that a specifically designed baby bottle 18 accompanies the bottle holder 10 in sale.

Figure 4:
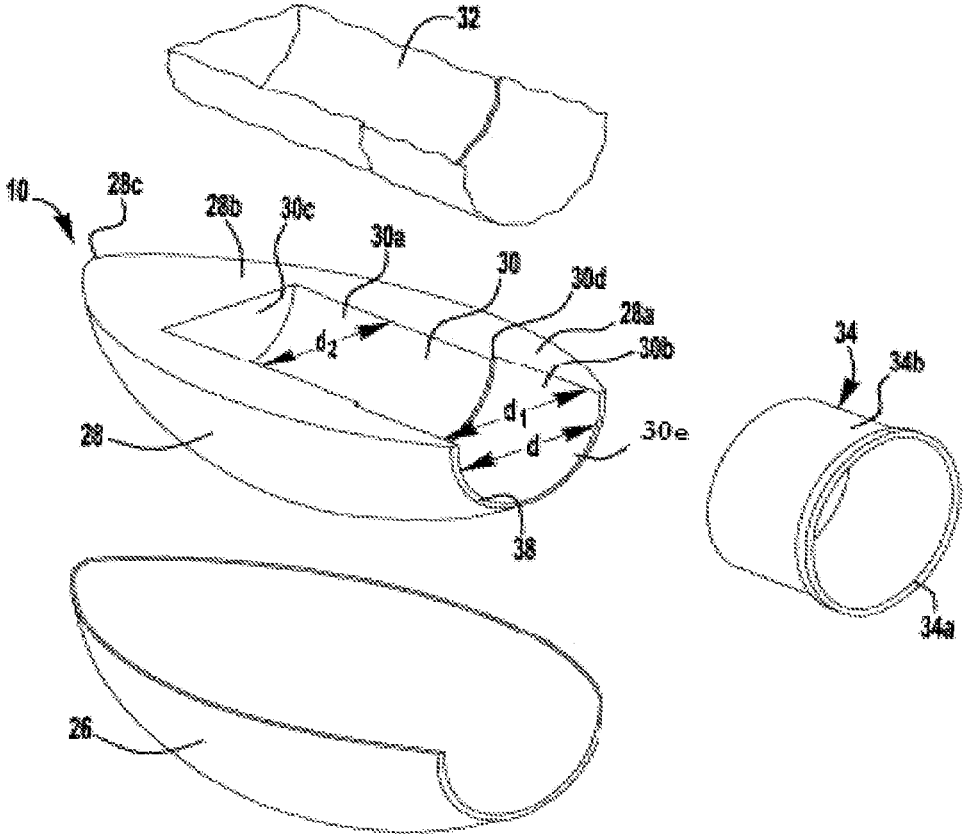
FIG. 4 is an exploded front, three-dimensional view of a sports ball bottle holder, in accordance with the present invention.

Regardless of the shape and size of the bottle holder 10, the elements that form the bottle holder remain the same. FIG. 4 illustrates an exploded, partial view of the bottle holder 10, including a skin cover 26, an elliptically shaped foam insert 28 with a central cavity 30 therein to secure a baby bottle or toddlers cup, a pouch lining 32, and a plastic shoulder bushing 34. While only half of the bottle holder 10 is illustrated, it is understood that the bottle holder is shaped as shown in FIG. 2.

The skin cover 26 may be constructed of any suitable material, such as synthetic leather, or a plastic polymer. The skin cover 26 of the bottle holder 10 serves as the outermost layer, which reinforces the overall structure of the bottle holder. The skin cover 26 can serve as a decorative layer that includes graphic indicia or textual indicia or a combination thereof. It may have a variety of cosmetic designs or colors that embody the ball design. As seen in FIG. 2 and FIG. 3, the football shaped embodiment 14 of the bottle holder 10 may have a dimpled texture that resemble the dimpling pattern found on a conventional football and synthetic brown leather, complete with white laces 36 to resemble an authentic football.

The skin cover 26 envelopes the elliptically shaped foam insert 28. Elliptically shaped foam insert 28 provides the shape and substance of the bottle holder 10. As seen in FIG. 4, there is a bottom portion 28*a* and a top portion 28*b* of the elliptically shaped foam insert 28. The bottom portion 28*a* has the shape of a traditional football, and comes to a point 28*c*, to resemble a conventional football. The top portion 28*a* has a circular opening 38 to receive the bottle 18 to be secured within the bottle holder 10, as seen in FIG. 3. The diameter d of the circular opening 38 may be a range of 1.5 inches to 4.5 inches. The diameter must be large enough to allow standard baby bottle 18 or toddler's cup to fit with the bottle holder 10.

A central cavity 30 is formed within the elliptically shaped foam insert 28 and extends from circular opening 38 to a location approximately halfway down the length of the foam insert to a closed bottom end 30*c*. The baby bottle 18 is placed and temporarily stored within the central cavity 30 of the foam insert 28 until the entire body of the baby bottle is completely encompassed by the bottle holder 10. The central cavity 30 is of circular shape and may be either uniform diameter through the length of the central cavity, or may have a plurality of differing diameters, as in FIG. 4. As illustrated, there is a first section 30*a* extending from the bottom end 30*c* towards the circular opening 38 and a second section 30*b* of the central cavity 30 which extends between first section 30*a* and the opening 38. Sections 30*a* and 30*b* are separated with a shoulder 30*d*. Second section 30*b* has a slightly larger diameter d1 than the diameter d2 of the first section 30*a*.

A pouch lining 32 lines the interior of the central cavity 30. Pouch lining 32 may be constructed of any suitable material, such as a flexible plastic. Pouch lining 32 is designed to grip the baby bottle 18, such that a variety of disparately sized baby bottles may be accommodated within the bottle holder 10. Further, pouch lining 32 serves to provide a surface that is easy to clean and wash. Should there a spill or leak from the baby bottle 18, pouch lining 32 protects the foam insert 28 of bottle holder 10, which is not designed to absorb liquids.

It is within the terms of the invention that the pouch lining 32 has insulating qualities, such that the liquid within the baby bottle 18 will maintain its temperature longer while inserted in bottle holder 10.

As shown in FIGS. 4 and 5, a plastic shoulder bushing 34 is inserted through opening 38 and secured against the inward facing surface 30*c* of second section 30*b* of the central cavity 30. To secure the plastic shoulder bushing 34 within the second section 30*b*, the bushing may be force fitted, secured thereto with an adhesive such as glue, or any other appropriate method. Plastic shoulder bushing 34 is designed to secure the pouch lining 32 in place by placing an open end of the pouch lining between the outer surface 34*b* of the bushing and the surface 30*e* of the second section 30*b*. Further, plastic shoulder bushing 34 grips the baby bottle 18, and temporarily secures it within the bottle holder 10. There is a lip 34*a* about the top circumference of the plastic shoulder bushing 34 to hold the bushing in place within the central cavity 30, as seen in FIG. 5.

It is within the terms of the embodiment that there be an insert 15 to be inserted within the central opening 38 so as to close the central opening and form a complete football, so as to resemble a conventional football, as seen in FIG. 2.

Figure 6:
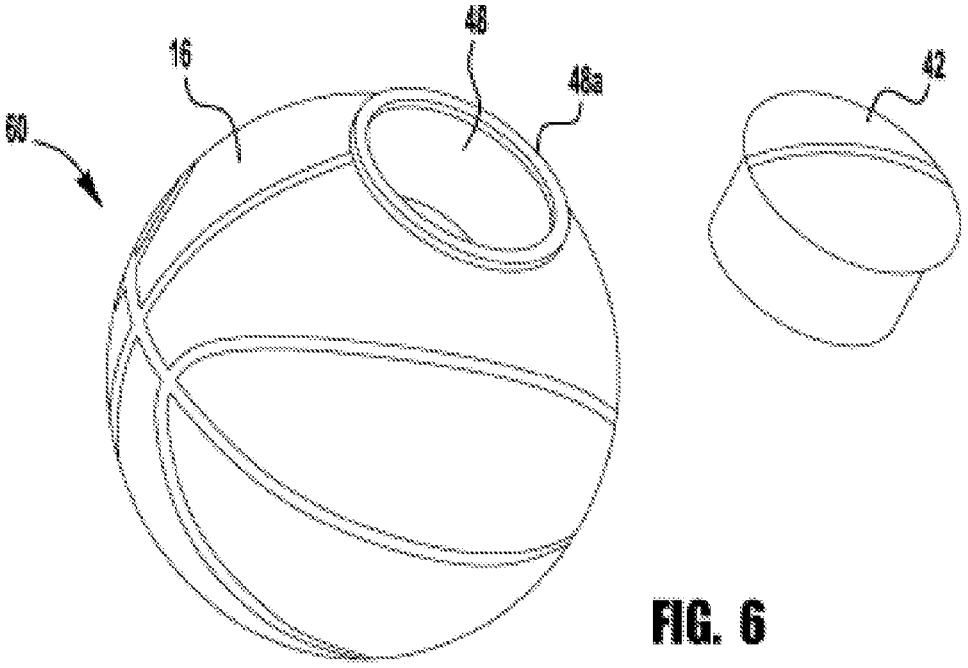
FIG. 6 is a front, three-dimensional view of an alternative embodiment of a sports ball bottle holder, in accordance with the present invention.
Figure 7:
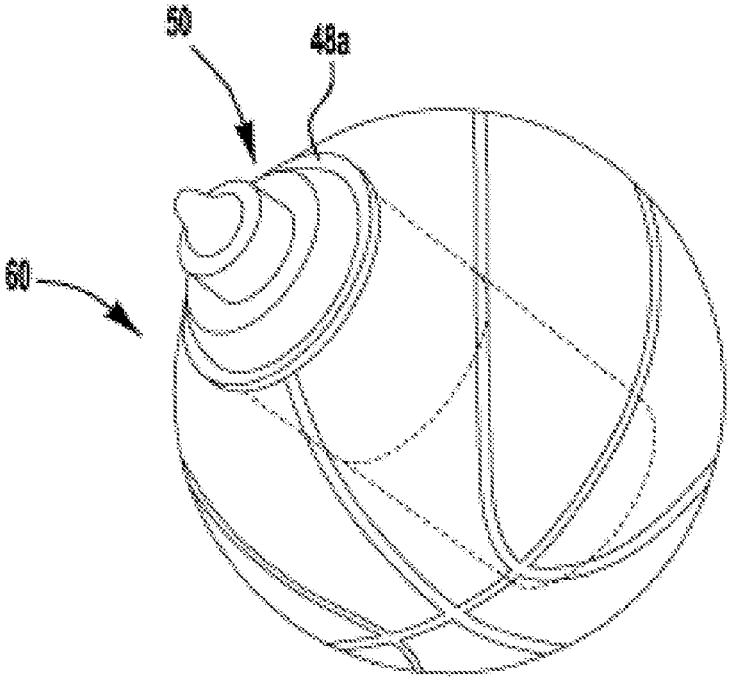
FIG. 7 is a front, three-dimensional view of an alternative embodiment of a sports ball bottle holder with a bottle, in accordance with the present invention.
Figure 8:
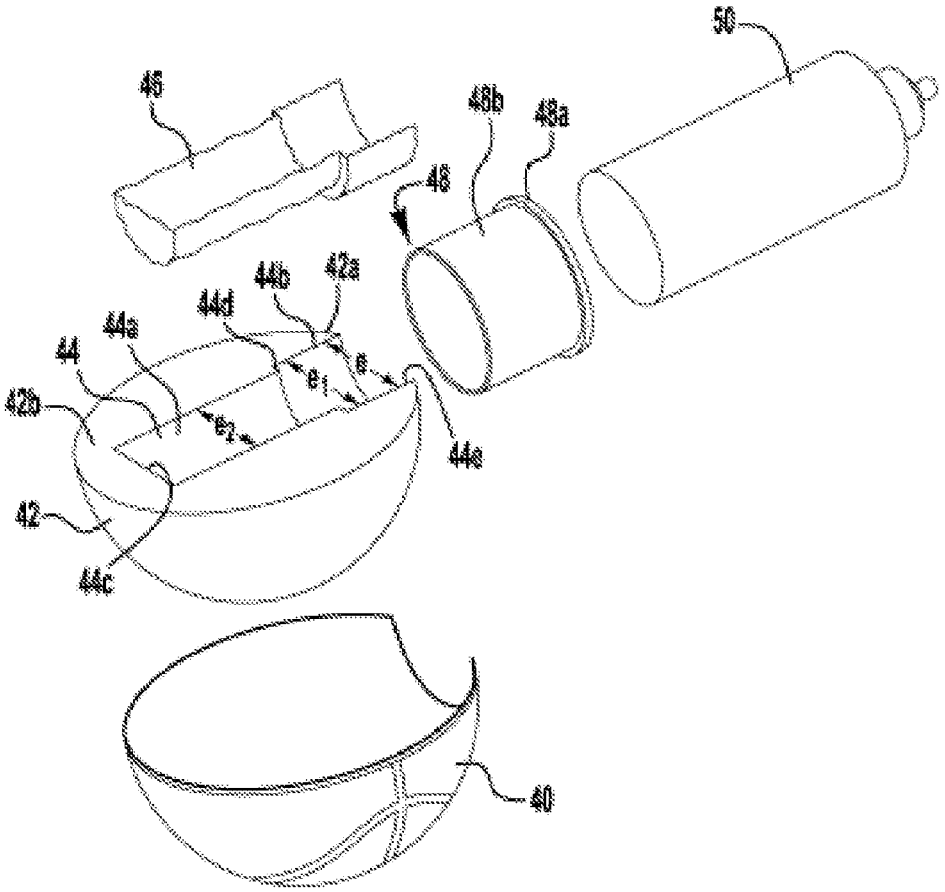
FIG. 8 is an exploded front, three-dimensional view of an alternative embodiment of a sports ball bottle holder with a bottle, in accordance with the present invention.

FIG. 6 and FIG. 7 illustrate the basketball shaped embodiment 16 of the bottle holder 60. In this embodiment, bottle holder 60 is spherical in nature. FIG. 8 illustrates an exploded, partial view of the bottle holder 10, including a skin cover 40, an spherically shaped foam insert 42 with a central cavity 44 therein to secure a baby bottle or toddlers cup, a pouch lining 46, and a plastic shoulder bushing 48. A baby bottle 50 is also shown in FIG. 7. While only half of the bottle holder 10 is illustrated, it is understood that the bottle holder is shaped as shown in FIG. 6.

The skin cover 40 may be constructed of any suitable material, such as synthetic leather, or a plastic polymer. The skin cover 40 of the bottle holder 10 serves as the outermost layer, which reinforces the overall structure of the bottle holder. The skin cover 40 can serve as a decorative layer that includes graphic indicia or textual indicia or a combination thereof. It may have a variety of cosmetic designs or colors that embody the ball design. As seen in FIG. 6 and FIG. 7, the basketball shaped embodiment 16 of the bottle holder 60 may have a smooth texture that resembles the pattern found on a conventional football and synthetic orange leather, to resemble an authentic basketball.

The skin cover 40 envelopes the spherically shaped foam insert 42. Spherically shaped foam insert 42 provides the shape and substance of the bottle holder 60. As seen in FIG. 8, there is a bottom portion 42*a* and a top portion 42*b* of the spherically shaped foam insert 28. The bottom portion insert 42*b* has the shape of a traditional basketball, and is circular, to resemble a conventional basketball. The top portion 42*a* has a circular opening 52 to receive the bottle 50 to be secured within the bottle holder 10, as seen in FIG. 7. The diameter e of the circular opening 38 may be a range of 1.5 inches to 4.5 inches The diameter must be large enough to allow standard baby bottle 50 or toddlers cup to fit with the bottle holder 60.

A central cavity 44 is formed within the spherically shaped foam insert 42 and extends from circular opening 52 to a location approximately halfway down the length of the foam insert to a closed bottom end 44*c*. The baby bottle 50 is placed and temporarily stored within the central cavity 44 of the foam insert 42 until the entire body of the baby bottle is completely encompassed by the bottle holder 60. The central cavity 44 is of circular shape and may be either uniform diameter through the length of the central cavity, or may have a plurality of differing diameters, as in FIG. 8. As illustrated, there is a first section 44*a* extending from the bottom portion insert 42*b* towards the circular opening 52 and a second section 44*b* of the central cavity 44 which extends between section 44*a* and the opening 52. Sections 44*a* and 44*b* are separated with a shoulder 44*d*. Second section 44*b* has a slightly larger diameter e1 than the diameter e2 of the first section 44*a*.

A pouch lining 46 lines the interior of the central cavity 44. Pouch lining 46 may be constructed of any suitable material, such as a flexible plastic. Pouch lining 46 is designed to grip the baby bottle 50, such that a variety of disparately sized baby bottles may be accommodated within the bottle holder 60. Further, pouch lining 46 serves to provide a surface that is easy to clean and wash. Should there a spill or leak from the baby bottle 50, pouch lining 46 protects the foam insert 42 of bottle holder 60, which is not designed to absorb liquids.

It is within the terms of the invention that the pouch lining 46 has insulating qualities, such that the liquid within the baby bottle 50 will maintain its temperature longer while inserted in bottle holder 60.

As shown in FIG. 7, a plastic shoulder bushing 48 is inserted through opening 52 and secured against the inward facing surface 44*c* of second section 44*b* of the central cavity 44. To secure the plastic shoulder bushing 48 within the second section 44*b*, the bushing may be force fitted, secured thereto with an adhesive such as glue, or any other appropriate method. Plastic shoulder bushing 48 is designed to secure the pouch lining 46 in place by placing an open end of the pouch lining between the outer surface 48*b* of the bushing and the surface 44*e* of the second section 44*b*. Further, plastic shoulder bushing 48 grips the baby bottle 50, and temporarily secures it within the bottle holder 60. There is a lip 48*a* about the top circumference of the plastic shoulder bushing 48 to hold the bushing in place within the central cavity 44, as seen in FIG. 8.

It is within the terms of the embodiment that there be an insert to be inserted within the central opening attached to the bottle holder 60 adjacent to the second section 44*b* of the central cavity 44. The function of this insert is to form a complete basketball, so as to resemble a conventional basketball.

It is within the terms of the embodiment that there be an insert 49 to be inserted within the central opening 52 so as to close the central opening and form a complete basketball, so as to resemble a conventional basketball, as seen in FIG. 6.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A bottle and cup holder for retaining a bottle or cup, comprising:

a skin cover forming an outermost layer of the holder;

a foam insert within the skin cover having a central cavity and an opening;

wherein the central cavity has a first section, a second section, and a shoulder;

wherein the second section is between the first section and the opening and the shoulder is between the first section and the second section; and wherein the second section has a larger diameter than the first section; and a shoulder bushing within the opening and extending into the central cavity from the opening to the shoulder to receive the bottle or cup.

2. The bottle and cup holder of claim 1 further including a pouch lining disposed within the central cavity for receiving the bottle or cup.

3. The bottle and cup holder of claim 2 wherein the pouch lining is constructed of a flexible plastic which is not designed to absorb liquids.

4. The bottle and cup holder of claim 1 wherein the skin cover is constructed of a suitable material selected from the group consisting of synthetic leather, plastic and polymer.

5. The bottle and cup holder of claim 1 wherein:

the foam insert has a bottom portion and a top portion; and wherein the opening is located in the top portion and wherein the opening is circular to receive the bottle or cup to be secured within the holder.

6. The bottle and cup holder of claim 5 wherein the foam insert is elliptically shaped and provides shape and substance for the holder.

7. The bottle and cup holder of claim 5 wherein:

the central cavity is formed within the foam insert and extends from the opening to a location approximately halfway down a length of the foam insert to a closed bottom end.

8. The bottle and cup holder of claim 7 wherein:

the central cavity has a plurality of differing diameters.

9. The bottle and cup holder of claim 7 wherein the shoulder bushing is received through the opening and secured against an inward facing surface of the second section of the central cavity.

10. The bottle and cup holder of claim 9 wherein the shoulder bushing is secured within the second section by force fit.

11. The bottle and cup holder of claim 9 wherein the pouch lining is secured in place by an open end of the pouch lining disposed between an outer surface of the bushing and an inner surface of the second section.

12. The bottle and cup holder of claim 1 further including an insert to be inserted within the opening so as to close the opening and form a complete ball.

13. A bottle and cup holder for retaining a bottle or cup, comprising:

a skin cover forming an outermost layer of the holder;

a foam insert within the skin cover having a central cavity and an opening at one end to receive the bottle or cup;

wherein the central cavity has a first section, a second section, and a shoulder;

wherein the second section is between the first section and the opening and the shoulder is between the first section and the second section;

wherein the central cavity has a uniform diameter through a length of the central cavity;

a pouch lining disposed within the central cavity for receiving the bottle or cup; and a shoulder bushing within the opening and extending into the central cavity from the opening to the shoulder to receive the bottle or cup.

14. The bottle and cup holder of claim 13 further including an insert to be inserted within the opening so as to close the opening and form a complete ball.

* * * * *